United States Patent [19]

Protz, Jr.

[11] Patent Number: 4,963,411

[45] Date of Patent: Oct. 16, 1990

[54] DECORATIVE RIBBON GARLAND AND METHOD OF MANUFACTURING SAME

[75] Inventor: William F. Protz, Jr., Manitowoc, Wis.

[73] Assignee: National Tinsel Manufacturing Company, Manitowoc, Wis.

[21] Appl. No.: 291,794

[22] Filed: Dec. 29, 1988

[51] Int. Cl.[5] ..... B32B 3/04; D04D 9/00

[52] U.S. Cl. ..... 428/123; 57/203; 112/417; 112/441; 223/46; 428/152

[58] Field of Search ..... 428/4–5, 428/7–10, 123, 152; 57/203, 210; 112/417, 441; 493/957, 958; 223/46

[56] References Cited

U.S. PATENT DOCUMENTS

| | | | |
|---|---|---|---|
| 621,435 | 3/1899 | Struss | 428/123 |
| 1,652,855 | 12/1927 | Fernandez | 428/10 |
| 1,905,392 | 4/1933 | Freydberg | 428/123 |
| 2,112,723 | 3/1938 | Wisoff | 428/4 |
| 2,228,441 | 1/1941 | Cohen | 428/10 X |
| 2,257,154 | 9/1941 | Bleyer | 428/4 |
| 3,637,452 | 1/1972 | Sanders | 428/10 |
| 3,782,495 | 1/1974 | Nassof | 428/152 X |
| 3,885,719 | 5/1975 | Williams | 223/103 |
| 4,070,818 | 1/1978 | Hamel | 57/210 X |
| 4,673,599 | 6/1987 | Vanderslice | 428/10 |

FOREIGN PATENT DOCUMENTS

| | | | |
|---|---|---|---|
| 777247 | 7/1957 | United Kingdom | 428/123 |
| 2089849 | 6/1982 | United Kingdom | 112/441 |

*Primary Examiner*—Henry F. Epstein

*Attorney, Agent, or Firm*—Michael D. Rechtin; Philip P. Mann

[57] ABSTRACT

A decorative ribbon is disclosed having a web portion comprising two flexible wires enclosed within its crimped hemmed edges. The flexible wires allow the substantially flat decorative ribbon to be formed into numerous shapes for numerous decorative purposes and also serve to lend structure and rigidity to an otherwise unsupported material. The crimped edges also aid in the forming of various shapes, and create random patterned wrinkles in the web which augment the appearance of the ribbon.

17 Claims, 1 Drawing Sheet

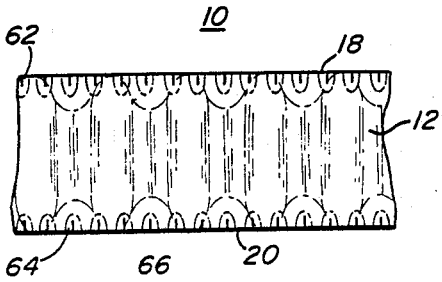
FIG. 1
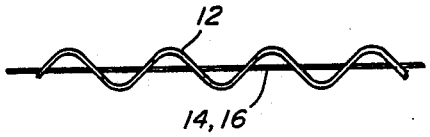
FIG. 5
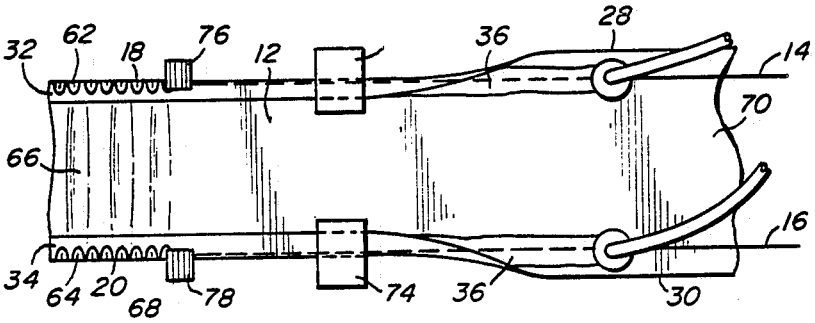
FIG. 2
FIG. 3
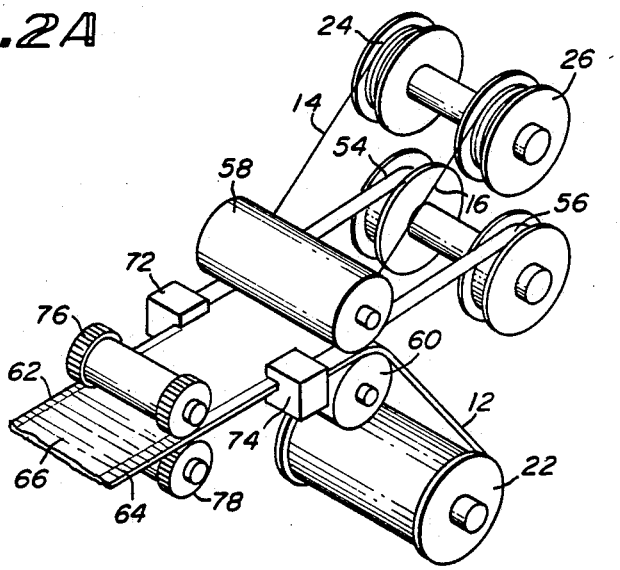
FIG. 2A
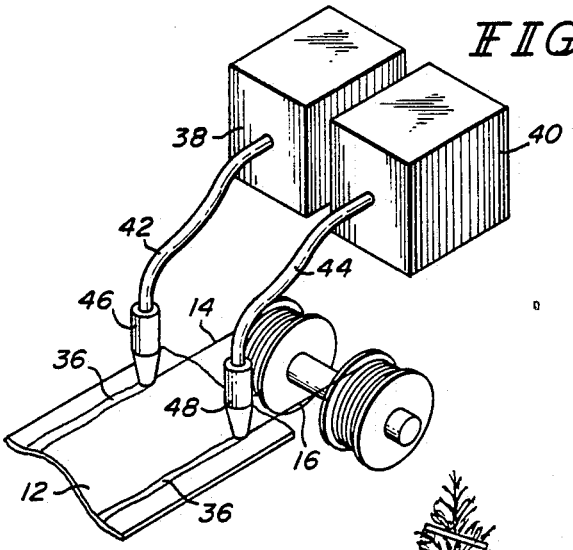
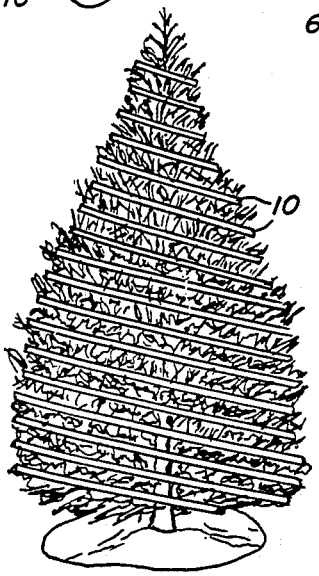
FIG. 4A
FIG. 4B
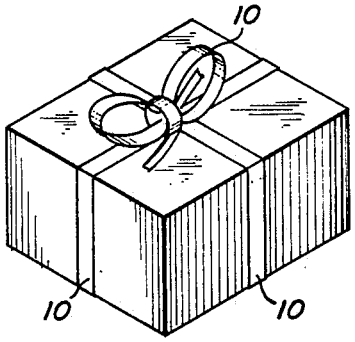

DECORATIVE RIBBON GARLAND AND METHOD OF MANUFACTURING SAME

BACKGROUND OF INVENTION

The present invention relates generally to a decorative ribbon and more particularly to a ribbon structure constructed from a thin polymer film having hemmed edges and flexible wires enclosed within the hemmed edges of the ribbon.

Decorative ribbon is used extensively on holidays and other special occasions for numerous purposes such as decorating Christmas trees, general craft applications, accenting wrapped boxes, decorating rooms, preparing floral arrangements and many other purposes.

Various inventions of this general type are known in the art, particularly in the area of Christmas tree decorations. Exemplary of this are U.S. Pat. No. 1,652,855, Fernandez; U.S. Pat. No. 2,112,723, Wisoff; U.S. Pat. No. 2,228,44I, Cohen; U.S. Pat. No. 2,257,154, Bleyer; U.S. Pat. No. 3,637,452, Sanders and U.S. Pat. No. 4,673,599, Vanderslice. Several disadvantages associated with the above inventions include delicate construction whereby the material of construction is easily ripped or torn, or the material tends to deteriorate rapidly. Other methods employed have a heavy, bulky construction which creates sagging such that the material cannot hold its shape. Other disadvantages include costly material and manufacturing expenses.

Some ribbons or garlands known in the art utilize a string or wire through their longitudinal center where fabric or other material is formed in cylindrical patterns. This type of design leaves the surface or edges of the ribbon loose. In the present invention a wire longitudinally supports each edge of the ribbon, thereby creating a durable construction which rigidly holds the ribbon surface and edges. The ribbon can be selectively mounted to the wires, enabling easy manipulation into the desired shape and also allowing generation of various decorative ruffle patterns.

SUMMARY OF THE INVENTION

Accordingly, it is an object of the present invention to provide a novel decorative ribbon which can be constructed with selected ruffle patterns and formed into various shapes as the user desires.

It is a further object of the present invention to provide a new type of ribbon which can be used for numerous decorative purposes.

It is a further object of the present invention to provide a novel decorative ribbon which is light weight, extremely durable and which will resist tearing and deterioration.

It is an additional object of the invention to provide an improved ribbon garland constructed from a flat extruded sheet material.

It is a particular object of the present invention to attain such a novel construction by utilizing a polymer film web portion with a wire running longitudinally along each edge.

It is an additional object of the present invention to provide a method of manufacturing a decorative ribbon from sheet or film in an economical and efficient manner.

Other objects, features and advantages of the present invention will be readily apparent from the following description of a representative embodiment thereof, taken in conjunction with the accompanying drawings, although variations and modifications may be effected without departing from the spirit and scope of the novel concepts embodied in the disclosure.

Nothing in the specification or the claims should be read to limit the use of the decorative ribbon disclosed herein for other uses including but not limited to craft applications, home decorating, packaging and other applications.

BRIEF DESCRIPTION OF THE DRAWINGS

FIG. 1 is a top plan view showing the decorative ribbon embodying the present invention;

FIG. 2 is a fragmentary top plan detail view illustrating a method of making the decorative ribbon embodying the present invention;

FIG. 2*a* is a fragmentary perspective view illustrating the method of FIG. 2 showing a mechanism for performing the gluing operation in one embodiment of the present invention;

FIG. 3 is a schematic illustration of the steps in a method of making the decorative ribbon for the present invention;

FIGS. 4*a* and 4*b* are perspective views illustrating various shapes for the decorative ribbon of the present invention; and FIG. 5 is a fragmentary side view of a wire sewn into the web in an alternate embodiment of the present invention.

DETAILED DESCRIPTION OF THE PREFERRED EMBODIMENT

A decorative ribbon 10 is provided comprising a web portion 12 and two flexible wires 14 and 16 which are illustrated in FIGS. 1 and 2. While the wires 14 and 16 are flexible, they also can retain a selected position obtained by shaping the ribbon 10. This can be accomplished, for example, by using dead soft galvanized and annealed steel wire. The decorative ribbon 10 is constructed of a suitably thin (for example, 1–2 mils) polymer film having hemmed edges 18 and 20 longitudinally therealong. Each of the flexible wires 14 and 16 is enclosed within a respective hem 32 and 34. Therefore, the flexible wires 14 and 16 give structural rigidity to the decorative ribbon 10 while allowing fabrication into the desired shape. The wires 14 and 16 are disposed within the hems 32 and 34 such that they are not observable.

The thin polymer film is preferably formed into a roll 22 as illustrated in FIG. 3 so that a continuous web of the film can be advanced from the roll 22 in a sheet form or flattened geometry. Wire rolls 24 and 26 continuously rotate to simultaneously advance the wires 14 and 16 with the web 12. The wires 14 and 16 are disposed on top of the web portion 12 proximate to unfinished edges 28 and 30 of the decorative ribbon 10.

Referring to FIGS. 1 and 2, the decorative ribbon 10 is preferably constructed from a suitable polymer film such as Mylar (a trademark of Dupont Corp.), polyvinyl chloride, acrylic, polypropylene, polystyrene, polyethylene, or other durable material such as metal foil, cloth or cellophane. Preferably the starting material is a sheet material which has substantial advantages over woven materials or the like. In one embodiment, these materials may be treated such that they are flame retardant. In addition since the invention is to serve as a decorative object, it should also be appealing to the eye. For this reason, the material used is attractively colored and has a glossy, silky or other appropriate finish. The polymer or other suitable film or cloth comprising the web portion 12 is preferably supplied in a continuous strip form.

In a preferred embodiment, the flexible wires 14 and 16 enclosed within each of the hems 32 and 34 are constructed of a soft steel wire of approximately twenty eight gauge thickness. The flexible wires 14 and 16 function to serve multiple purposes. For example, they provide structure and rigidity to an otherwise flimsy and shapeless material. In addition the wires 14 and 16 serve to allow the decorative ribbon 10 to be bent, folded, shaped, and otherwise manipulated into numerous desired geometries.

The hems 32 and 34 and the hemmed edges 18 and 20 are formed by folding approximately ¼ inch of the unfinished web edges 28 and 30 over and on top of the web portion 12 into a "C"-shape. In the preferred embodiment the hems 32 and 34 are held permanently closed by applying an adhesive 36 to the area to be joined, as shown in FIG. 2 and shown in more detail in FIG. 2*a*. FIG. 2*a* illustrates one method of applying the adhesive 36 contained within tanks 38 and 40. Extending from the tanks 38 and 40 are heated hoses 42 and 44 which can be positioned to apply the adhesive 36 to the areas of the web 12. Nozzle dispensers 46 and 48 are attached to the end of the hoses 42 and 44 and are directed to the areas to be treated. The adhesive 36 is heated and applied in a stream or is sprayed onto the web 12, and the adhesive 36 covers the flexible wires 14 and 16 as they move past the nozzle dispenser 46 and 48. For example, the adhesive 36 can be a sprayable hot melt sprayed through nozzle dispensers 46 and 48.

In one alternative embodiment the hems 32 and 34 are held permanently closed by adhesive, backless tape (transfer adhesive), such as tape 54 and 56 dispensed along the sides of the web 12 proximate to the longitudinal unfinished edges 28 and 30 (see FIG. 3). The flexible wires 14 and 16 are then disposed on the tape 54 and the hems are subsequently folded over.

In another alternative embodiment shown in FIG. 3, the hems 32 and 34 can be heat sealed together using rollers 58 and 60 which can be heated.

In an additional alternative embodiment, the flexible wires 14 and 16 are woven or sewn through the web 12 as illustrated in FIG. 5, thereby permanently closing the hems 32 and 34. The sewing operation can change the ribbon's appearance by varying the stitch or by having the flexible wires 14 and 16 partially visible. The hems 32 and 34 create smooth finished longitudinal hemmed edges 18 and 20, and also prevent the flexible wires 14 and 16 from being displaced from the web 12.

In the preferred embodiment, the hems 32 and 34 having the flexible wires 14 and 16 enclosed therein are continuously crimped along their longitudinal axis. Crimped portions 62 and 64 shown in FIG. 3 create a generally irregular pattern 66 in the web 12 thereby adding to its attractiveness, while also allowing the user to readily form the ribbon 10 into various shapes. The crimped portions 62 and 64 provide desirable flexibility and numerous pivot points which increase the degrees of freedom in forming a desired shape. This is especially true where the decorative ribbon 10 is bent into tight loops or turns. The decorative ribbon 10 has a number of functional purposes and can be manipulated into many shapes as shown in FIGS. 4*a* and 4*b*. Notwithstanding the flexibility and adaptability of the decorative ribbon 10, the body 68 of the decorative ribbon 10 itself maintains a substantially flat condition.

In another form of the invention, the web portion 12 is selectably fed at different linear rates compared to the feed rate of the flexible wires 14 and 16. The adhesive can then be added at selected rates. In this manner, the web portion 12 can be ruffled at preferred spacings to provide further decorative effects for the ribbon 10.

The present invention also contemplates a method by which the decorative ribbon 10 can be constructed. FIG. 3 illustrates in schematic form, a continuous web 12 of thin polymer film being advanced in a flattened geometry. The continuous web 12 is advanced along a conveyor using the rollers 58 and 60. Along with the web 12, the flexible wires 14 and 16 are also advanced through the conveyor rollers 58 and 60. The wires 14 and 16 are disposed on the top side 70 of the web 12 along each of the longitudinal unfinished edges 28 and 30. The flexible wires 14 and 16 are disposed on the web 12 approximately 3/16 inch from each of the longitudinal unfinished edges 28 and 30. The adhesive 36 is then applied to the web 12 in a stream proximate to the areas which are to be joined, as shown in FIG. 2. As described above, heat sealinq or double sided tape may also be utilized as illustrated in FIG. 3. The web 12 and the flexible wires 14 and 16 are synchronously advanced through the rollers 58 and 60. With the adhesive 36 disposed on the web 12, the unfinished edges 28 and 30 are folded by folding guides 72 and 74 onto the flexible wires 14 and 16 and the adhesive 12, thereby forming the hems 32 and 34. The web 12, with the flexible wires 14 and 16 enclosed within the hems 32 and 34, is then advanced through crimping wheels 76 and 78 which continuously crimp the hemmed edges 18 and 20, so as to form irregular patterns 66 in the completed form of the decorative ribbon 10.

While preferred embodiments of the present invention have been illustrated and described, it will be understood that changes and modifications can be made therein without departing from the invention in its broader aspects. Various features of the invention are defined in the following claims.

What is claimed is:

1. A decorative ribbon made from a thin flexible film comprising:

a web portion having a hem along only the longitudinal edges; and a flexible wire enclosed in and attached to each of said hems, said hems being sealed so as to create smooth finished longitudinal hemmed edges and prevent said flexible wires from being displaced from within said hems, said web portion being selectively displaced during manufacture relative to said flexible wires to form a ruffled pattern for said web portion and said ruffled pattern having generally parallel lines resulting from said displacement of said web portion.

2. A decorative ribbon made from a thin polymer film comprising:

a web portion in continuous strip form having hems only along each longitudinal edge;

a flexible wire enclosed in each of said hems; said hems being permanently closed thereby creating smooth finished longitudinal hemmed edges and preventing said flexible wires from being displaced and said hems with said flexible wires fixedly held therein sales being continuously crimped along their longitudinal axis, said crimping forming generally irregular random, parallel line patterns in said ribbon.

3. A decorative ribbon as claimed in claim 2, wherein said ribbon is formed into various shapes and said wires retain said ribbon in said shapes.

4. A decorative ribbon as claimed in claim 2, wherein said hems are closed by a method from one of the group consisting of, heat sealing, double sided taping and adhesive bonding.

5. A decorative ribbon as claimed in claim 2, wherein said ribbon is constructed from one of the group consisting of mylar, polyvinyl chloride, acrylic polypropylene, polystyrene, metal foil and cellophane.

6. A decorative ribbon as claimed in claim 2, wherein said decorative ribbon is flame-retardant.

7. A decorative ribbon as claimed in claim 2, wherein said polymer film is decorated in one or more colors, finishes and textures.

8. A decorative ribbon as claimed in claim 2, wherein said flexible wires are sewn into said hems.

9. A decorative ribbon as claimed in claim 2, wherein said flexible wires are approximately 28 gause in thickness.

10. A decorative ribbon as claimed in claim 2, wherein said flexible wires are constructed of relatively soft steel.

11. A decorative ribbon as claimed in claim 2, wherein said hems are approximately $\frac{1}{4}$ inches wide and run continuously along said longitudinal hemmed edges.

12. A decorative ribbon as claimed in claim 2, wherein said polymer film is colored and finished on both its front and back sides and wherein said hems are substantially contiguous with said film such that both of said front and back sides can be visible and equally decorative to the viewer.

13. A decorative ribbon made from a thin flexible film comprising:

a web portion in a continuous strip form having only a first wire and a second wire along only the longitudinal edges of said web portion;

said first wire positioned lengthwise proximate to the first longitudinal edge of said web portion and fixedly attached within a hem;

said second wire positioned lengthwise proximate to the second longitudinal edge of said web portion and fixedly attached within a hem; and said first wire and said second wire being continuously crimped inside of aid hems thereby providing said ribbon a decorative appearance arising from imposing irregular, random, but generally parallel ruffled lines in said ribbon.

14. A method for making decorative ribbon from a thin polymer film comprising:

from rolls of a continuous strip of thin walled polymer film;

advancing a continuous strip of thin walled polymer film along a conveyor means, said strip of polymer film laying flat;

advancing a light gauge wire along each longitudinal unfinished edge and on the top side of said strip;

synchronously advancing said strip and light gauge wires through said conveYor means;

dispensing adhesive over said wires proximate to each of said longitudinal unfinished edges of said strip;

folding said unfinished longitudinal edges over said wires and adhesive thereby forming hems longitudinally along each of said edges; and crimping said side edges continuously along their respective longitudinal axis.

15. The method for making a decorative ribbon according to claim 14, wherein said step of dispensing adhesive comprises advancing double sided tape between said fold of each of said hems.

16. The method of claim 14, wherein said step of dispensing adhesive comprises disbursing an adhesive between said fold of each of said hems.

17. The method for making decorative ribbon according to claim 14, wherein said hem is heat sealed rather than adhesively joined.

* * * * *

UNITED STATES PATENT AND TRADEMARK OFFICE

CERTIFICATE OF CORRECTION

PATENT NO. : 4,963,411

DATED : Oct. 16, 1990

INVENTOR(S) : William F. Protz, Jr.

It is certified that error appears in the above-identified patent and that said Letters Patent is hereby corrected as shown below:

In column 3, line 31, "dispenser" should be --dispensers--.

In column 4, claim 2, line 67, "sales" should be --also--.

In column 5, claim 5, line 12, "mylar" should be --Mylar--.

In column 5, claim 5, line 12, "acrylic polypropylene" should be --acrylic, polypropylene--.

In column 5, claim 9, line 22, "gause" should be --gauge--.

In column 5, claim 11, line 29, "run continuously" should be --run so continuously--.

In column 6, claim 14, line 22, "conveYor" should be --conveyor--.

In column 6, claim 13, line 8, "aid" should be --said--.

In column 6, claim 14, line 14, "from rolls of" should be --forming rolls from--.

Signed and Sealed this

Sixth Day of October, 1992

*Attest:*

DOUGLAS B. COMER

*Attesting Officer*

*Acting Commissioner of Patents and Trademarks*